US005380582A

United States Patent [19]

Neely, Jr. et al.

[11] Patent Number: 5,380,582

[45] Date of Patent: Jan. 10, 1995

[54] RECYCLABLE BALE WRAP MADE FROM A THERMALLY BONDED, NEEDLEPUNCHED, POLYESTER NONWOVEN

[75] Inventors: William G. Neely, Jr., Charlotte, N.C.; Gordon Oran, Spartanburg, S.C.

[73] Assignee: Hoechst Celanese Corporation, Somerville, N.J.

[21] Appl. No.: 997,686

[22] Filed: Dec. 28, 1992

[51] Int. Cl.[6] ..... B32B 5/06; D04H 1/44; D04H 1/46; D04H 1/70

[52] U.S. Cl. ..... 428/220; 28/112; 112/441; 156/93; 156/148; 206/524.6; 428/35.2; 428/36.1; 428/113; 428/224; 428/287; 428/300

[58] Field of Search ..... 28/112; 156/148; 206/524.6; 428/220, 287, 113

[56] References Cited

U.S. PATENT DOCUMENTS 5,104,703 4/1992 Rachman et al. ..... 428/35.6

*Primary Examiner*—James C. Cannon

*Attorney, Agent, or Firm*—Philip P. McCann; Thomas C. Doyle

[57] ABSTRACT

A non-woven recyclable polyester fabric suitable for use as a bale covering that is a single layer batt formed of crosslapped fiber having a structure compacted by needlepunching and calendering. A process for producing this non-woven recyclable polyester fabric that includes forming a web of fiber, crosslapping the web to form a batt, needlepunching the batt, and calendering the batt under suitable conditions.

6 Claims, No Drawings

RECYCLABLE BALE WRAP MADE FROM A THERMALLY BONDED, NEEDLEPUNCHED, POLYESTER NONWOVEN

BACKGROUND OF THE INVENTION

The present invention is directed to the field of non-woven fabrics in general and is directed to a single layer non-woven recyclable polyester fabric suitable for use as bale covering having high strength and resistance to tears and abrasion and to which labels can stick. The fabric of the present invention can be recycled. The present invention is also directed to a process for producing such a non-woven fabric.

For many years fiber producers have sought a solution to the problem of wrapping bales of fibers to protect the fibrous material from contamination and damage during shipping. Some wraps commonly used are jute or burlap. Other wraps include polypropylene. Such wraps require disposal in landfills.

Other wraps include woven polypropylene, the predominant bale wrapping material. These wraps however, fibrillate in use, the polypropylene strands becoming closely entwined with the fibers, and thereby contaminating it. Such contamination cannot be separated and is extremely difficult to detect in raw fibers. Moreover, polypropylene wraps are not biodegradable or recyclable and have few end uses. An example of this type of woven wrap is disclosed in U.S. Pat. No. 4,557,958 (Barkis) wherein woven polypropylene or polyethylene fabric is infused with a series of stripes of thermoplastic resin to prevent fraying when the fabric is cut.

U.S. Pat. No. 5,104,703 (Rachman et al) discloses a single layer non-woven fabric suitable for use as a cotton bale covering that is a single layer batt formed of a blend of fibers including polyester and low melt thermoplastic fibers such as bicomponent fibers. As will be shown, the present invention exhibits superior products to the blend of the polyester fibers and the binder fibers.

It is a primary object of this invention to provide a recyclable polyester bale cover usable for fiber materials.

A further object of this invention is the provision of a new type of single layer non-woven recyclable fabric suitable for use as polyester bale covering, wherein a combination of needle punching and calendering lend high strength to the fabric.

It is a further object of this invention to provide a non-woven single layer recyclable polyester fabric that does not fibrillate in use as do woven polypropylene bale wrapping materials.

Still another object is to provide a non-woven single layer recyclable polyester fabric that provides greater resistance to tears, rips and holes over conventional woven polypropylene bale wrapping materials.

A further object is to provide a non-woven single layer recyclable polyester fabric that is comparable in cost to polypropylene wraps.

Still another object of the present invention is to provide a non-woven polyester fabric that is recyclable. The fabric can be used in polyester bale wrap. Recyclability of the wrap is further enhanced with the use of polyester labels.

SUMMARY OF THE INVENTION

These and other objects of the invention are achieved by provision of a non-woven polyester recyclable fabric comprising a batting of crosslapped recyclable polyester staple fiber that has been needle punched and calendered. The recyclable polyester bale covering is formed essentially of non-woven fabric that is crosslapped, needlepunched, calendered, and cut and sewed into the fabric suitable for the recyclable bale cover.

DESCRIPTION OF THE PREFERRED EMBODIMENTS

In describing the preferred embodiments of the subject invention illustrated herein, specific terminology will be resorted to for the sake of clarity. However, the invention is not intended to be limited to the specific terms so selected and resulting batt is stabilized for further processing by needling at a specific density of about 1,200 to about 3,000 penetrations per square inch to achieve a weight of preferably between 4 and 14 ounces per square yard. The resulting batt is then calendered by pressing the batt between two rolls at a temperature of between 300° and 500° F. and calendered to a thickness of between 0.01 and about 0.100 inch. The resulting fabric is then subject to conventional techniques of fabric rollup.

The fabric can be used on various types of automatic balers, i.e., Sunds, Lumus, etc. The fabric can also be made into sewn bags using conventional cut and sew techniques and equipment. Such fabric is suitable as a direct replacement for woven polypropylene material.

The all polyester bale wrap, including a polyester label may be recycled using conventional methods to recycle polyester. The all polyester fabric is ground into particles which are processed through glycolysis or methanolysis to recycle the material.

COMPARATIVE EXAMPLE

Various samples were prepared using a blend of 90% polyester fibers and 10% bicomponent fibers. The bicomponent fiber commercially available as Type 254 from Hoechst Celanese it is to be understood that each specific term includes all technical equivalents which operate in an equivalent manner to accomplish a similar purpose.

The fiber used is a recyclable polyester fiber. These fibers should be between about 2 inches and 4 inches in length and have a denier or denier equivalent between about 2.25 and 15 dpf. The fibers are individualized, that is separated into individual fibers using conventional textile fiber carding equipment, and are then formed into a web using fibrous web forming devices.

The fibers may also be treated with a fiber lubricant or finish before or during processing to permit subsequent needle operations to be performed. Such a fiber finish precludes excessive needle breakage, poor fiber penetration, inefficient stitching, and reduced stitching breaks. Finishes may include silicone lubricants, metallic soaps and low molecular weight polyethylene waxes to provide needle lubrication. Methods of application include padding, spraying or immersion and press rolling. The fibers may further be treated with a flame retardant.

The fibrous web is increased in thickness by crosslapping or layering through the use of conventionally known multiple forming devices such as disclosed in U.S. Pat. No. 4,183,985. The has a polyester core in an isophthalic polyester sheath material. The fibers were processed into a fibrous web needle punched according to standard procedures and calendered. It was found that the fabrics calendered at 400° F. yielded a stiffer fabric. Such fabrics are found to result in fabric tears as well as contamination of the fibrous materials in the bales due to the clinging of the bale cover material. In another case the fabrics were calendered at 300° F. to increase elongation. In such cases tearing was not a problem with these fabrics. However, fiber clinging was still a problem. It appeared from other comparative examples that the inclusion of the binder fibers such as a bicomponent fiber resulted in fiber cling of the cover to the fibers within the bale.

EXAMPLE

The present invention will be illustrated with the following example. A blend of 65% 3 dpf by 3 inch and 35% 6 dpf and 3 inch polyester was used. The blend was carded, cross-lapped, and needled at 1,200 psi.

It has been found that when all polyester fibers incorporated into the fabric are without a binder fiber are calendered from about 0.021 to about 0.018 inches using the calender roll at about 475° F. with the pressure of the calender set at 1,500 psi, a fabric was produced that resulted in improved tearing resistance and improved clinging resistance.

It will be apparent to those skilled in the art, that the present invention may be practiced in a wider variety of embodiments without materially departing from the spirit and scope of this invention. It is also to be understood that in the foregoing specification, specific embodiments and components thereof, have been illustrated and discussed by way of illustration only and not of limitation, and that the invention may be practiced by those skilled in the art utilizing a wide variety of materials and configurations without departing from the true spirit of the invention.

We claim:

1. A recyclable polyester bale cover consisting essentially of a single layer of non-woven fabric having been produced by the steps of:

(a) forming a fibrous web consisting of recyclable polyester fiber;

(b) cross-lapping said fibrous web to form a single layer batt;

(c) needlepunching said batt;

(d) calendering said batt under heating conditions to form a fabric suitable for bale wrap, to which labels may be stuck; and (e) cutting and sewing said fabric into said recyclable bale cover.

2. A recyclable polyester bale cover of claim 1 wherein said fabric has a thickness from about 0.010 inch to about 0.1 inch.

3. A recyclable all polyester bale wrap cover comprising a single layer of non-woven fabric consisting essentially of a single batt layer formed of cross-lapped recyclable polyester staple fiber without a binder fiber, said batt having a compacted structure by needling extending throughout said batt at a specific density of about 1200 to about 3000 penetrations per square inch and calendaring of the needled single batt layer under heating conditions to bond said fibers.

4. A recyclable polyester bale cover of claim 3 wherein said compacted structured batt has a thickness from about 0.010 to about 0.1 inch.

5. A process for producing a polyester non-woven fabric suitable for use in a recyclable polyester bale cover consisting essentially of the steps:

(a) forming a fibrous web consisting of recyclable polyester fibers without a binder;

(b) cross-lapping said fibrous web to form a single layer batt;

(c) needlepunching said batt; and (d) calendering said batt under heating conditions to form a fabric suitable for bale wrap, to which labels may be adhesively stuck.

6. A process of claim 5 wherein said batt is calendered to a thickness of from about 0,010 inch to about 0.1 inch.

* * * * *